US006034336A

United States Patent [19]

Lee

[11] Patent Number: 6,034,336

[45] Date of Patent: Mar. 7, 2000

[54] KNOB ASSEMBLY FOR USE IN ELECTRONIC APPLIANCES

[75] Inventor: Jong-Eun Lee, Seoul, Rep. of Korea

[73] Assignee: Daewoo Electronics Co., Ltd., Rep. of Korea

[21] Appl. No.: 09/100,467

[22] Filed: Jun. 19, 1998

[30] Foreign Application Priority Data

Aug. 25, 1997 [KR] Rep. of Korea ..... 97-40477

[51] Int. Cl.[7] ..... H01H 25/04

[52] U.S. Cl. ..... 200/18; 200/6 A

[58] Field of Search ..... 200/4, 5 R, 6 R, 200/6 A, 17 R, 18, 332, 336

[56] References Cited

U.S. PATENT DOCUMENTS

| | | | |
|---|---|---|---|
| 3,679,846 | 7/1972 | Dillon et al. | 200/6 A |
| 3,917,918 | 11/1975 | Vannest et al. | 200/6 A |
| 4,520,242 | 5/1985 | Kopsho, Jr. | 200/6 A |
| 5,773,773 | 6/1998 | McCauley et al. | 200/6 A |

FOREIGN PATENT DOCUMENTS

| | | | |
|---|---|---|---|
| 0583635 | 12/1946 | United Kingdom . | |
| 2273203 | 6/1994 | United Kingdom | H01H 23/30 |

*Primary Examiner*—Michael Friedhofer
*Attorney, Agent, or Firm*—Pennie & Edmonds LLP

[57] ABSTRACT

A knob assembly is utilized for selecting a desired function of electronic appliances. The knob assembly includes a front panel having a circular mounting hole at front thereof, a knob freely moved to a voluntary direction, and a front circuit board having tact switches disposed to be pressed by an operation of the knob. The front panel has a tension holder backwardly projected around the mounting hole. The holder consists of a first group of tension ribs vertically and horizontally located and a second group of tension ribs located between the first group of tension ribs, the first group of tension ribs being provided with a groove, respectively. The knob has a knob handle disclosed from the front panel, a rotational sphere inserted into the tension holder, and a contacting member, the rotational sphere being provided with projections on a periphery surface which are coupled with each groove of the first group of tension ribs. The knob is restored by a restoring fot group of tension ribs. The knob is restored by a restoring force of the tension holder to a standard position which allows the projections of the rotational sphere to be always coupled with each groove of the first group of tension ribs.

3 Claims, 5 Drawing Sheets

KNOB ASSEMBLY FOR USE IN ELECTRONIC APPLIANCES

FIELD OF THE INVENTION

The present invention relates to a knob assembly for use in electronic appliances; and, more particularly, to a knob assembly, capable of carrying out a reliable function selecting operation and having a reduced number of parts or components.

DESCRIPTION OF THE PRIOR ART

In general, knobs incorporated in electronic appliances are used to select desired functions. For example, in a video cassette recorder, a knob for selecting functions such as Power, Play, Eject, Review, etc, is disposed at a front panel thereof.

There are shown in FIGS. 1 and 2 a video cassette recorder including a front panel 4 mounted at front of a main chassis 2 and a knob assembly 20 mounted through and protruding from a mounting hole 3 of the front panel 4. A main circuit board (not shown) is mounted at bottom of the main chassis 2 and a front circuit board 10 is mounted at back of the front panel 4. Further, a tact switch 8 is placed at front of the front circuit board 10 in such a way for it to press down when the knob assembly 20 is operated, thereby allowing a desired function of the video cassette recorder to be carried out.

The prior art knob assembly 20, as best shown in FIG. 2, includes a button portion 22 on a front panel 4, a pusher 26 projected backwardly from the button portion 22, and a supporting plate 28 attached between the button portion 22 and the pusher 26. Further, the supporting plate 28 is provided with a tension rib 30 and a coupling portion 32 on an upper portion thereof. The coupling portion 32 is provided with a hole 34 through which a coupling pin 40 projected backwardly from the front panel 4 is inserted. The tip end 42 of the coupling pin 40 is fused by a suitable fusing means to thereby be coupled with the coupling portion 32.

However, in the prior art knob assembly, the tip end 42 of the coupling pin 40 must be pressed to and fused with the coupling portion 32 by a fusing means, for example, such as a fusing jig, which is heated to 300° C. which as well as time consuming, increases the manufacturing cost thereof. In addition, the tension rib 30 which is relatively thin may become deformed by the heat produced during the fusing process, which, in turn, may cause the knob assembly to be eccentrically mounted in the mounting hole 3 of the front panel 4 and cause the knob assembly to malfunction.

In case of an integrated knob assembly capable of carrying out a number of functions, the need to perform the fusing process described above increases as the number of functions the integrated knob assembly requires to carry out, making it externally difficult to assemble. In addition, since the integrated knob assembly is operated by a tension of the tension rib, the knob must be pressed by a predetermined force, making it rather cumbersome to operate. Furthermore, a tact switch other than the selected tact switch may be mistakenly pressed, resulting an unexpected function being performed.

SUMMARY OF THE INVENTION

Accordingly, it is an object of the invention to provide a knob assembly employing a rotational sphere suitable for use to carry out a reliable function selecting operation.

It is another object of the invention to provide a knob assembly which is capable of reducing an assembling time, depending to a reduced number of parts of components.

The above and other objects of the present invention are accomplished by providing a knob assemble for use in electronic appliances, said assembly comprising:

a front panel having a circular mounting hole at front thereof and a tension holder backwardly projected around the mounting hole, the holder consisting of a plurality of tension ribs in which a first group of tension ribs are vertically and horizontally located and a second group of tension ribs are located between the first group of tension ribs, the first group of tension ribs being provided with a groove, respectively;

a knob freely moved to a voluntary direction and having a knob handle disclosed from the front panel, a rotational sphere inserted into the tension holder, and a contacting member, the rotational sphere being provided with projections on a periphery surface which are coupled with each groove of the first group of tension ribs; and a front circuit board having tact switches disposed to be pressed by the contacting member of the knob, wherein the knob is restored by a restoring force of the tension holder to a standard position which allow the projections of the rotational sphere always to be coupled with each groove of the first group of tension ribs.

BRIEF DESCRIPTION OF THE DRAWINGS

The above and other objects, features and advantages of the present invention will become apparent from the following detailed description given in conjunction with the accompanying drawings, in which.

DETAILED DESCRIPTION OF THE PREFERRED EMBODIMENTS

Figure 1:
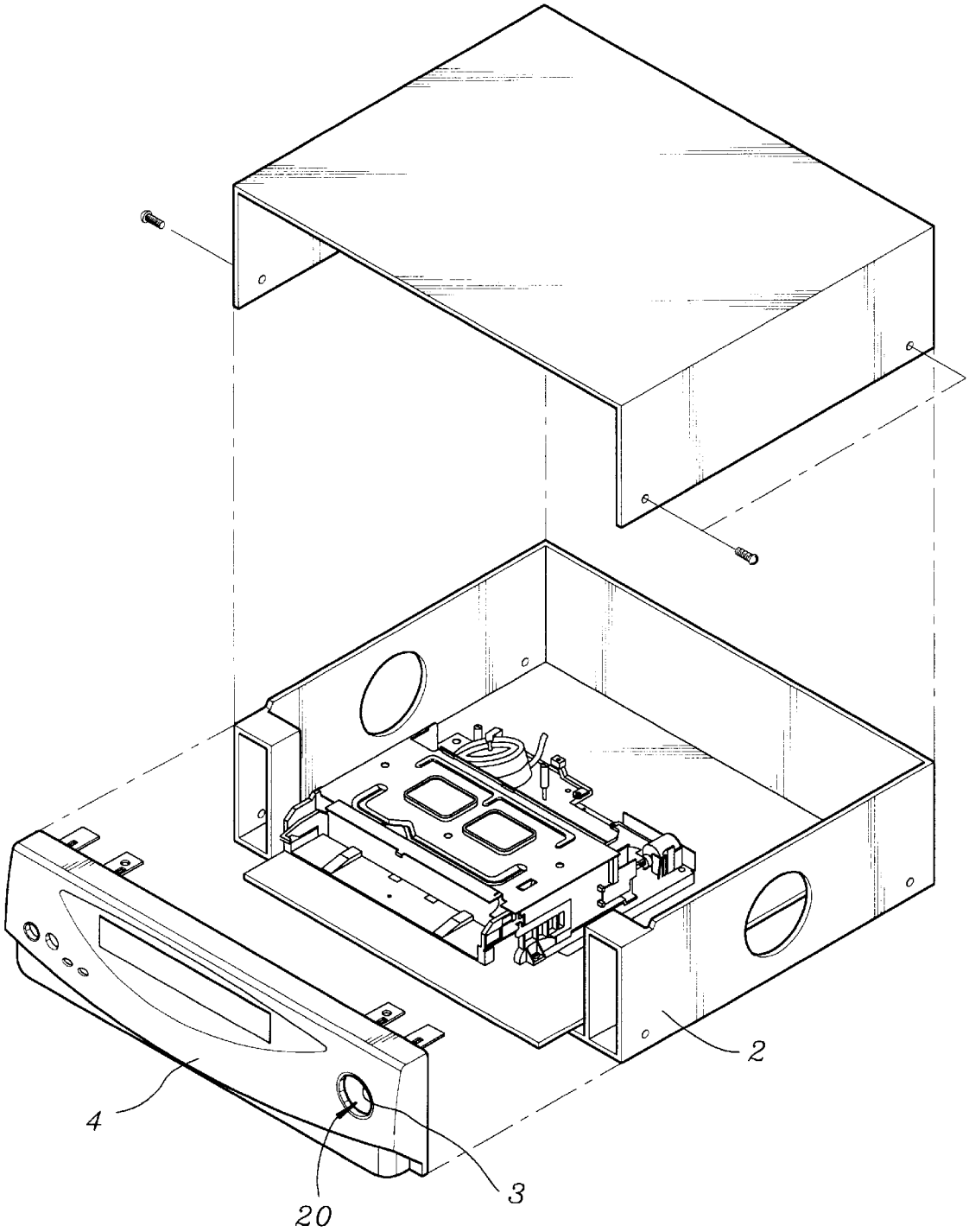
FIG. 1 shows an exploded perspective view of a video cassette recorder as an example of electronic appliances.
Figure 2:
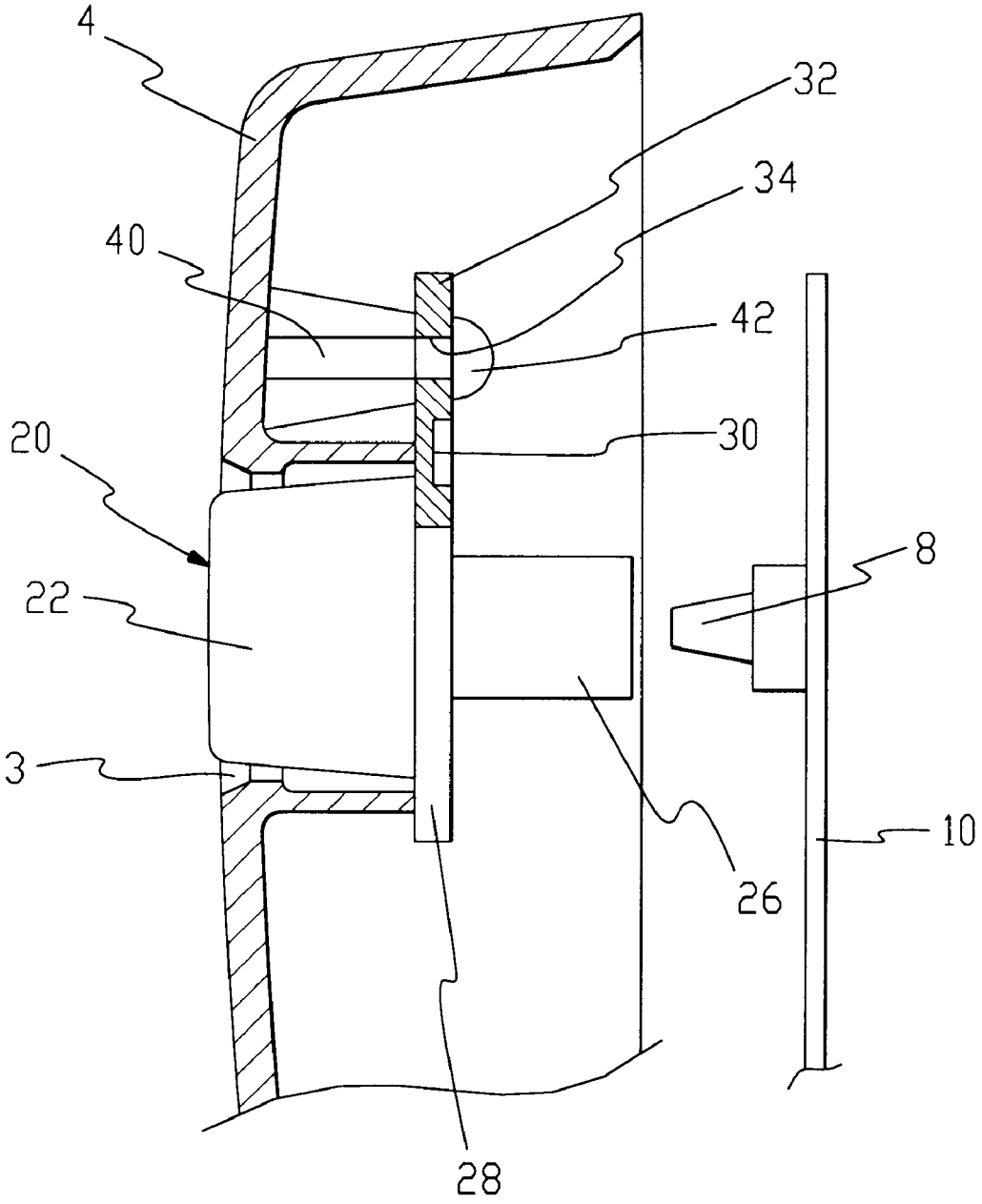
FIG. 2 presents a cross sectional view presenting a prior art knob assembly used to the video cassette recorder of FIG. 1.
Figure 3:
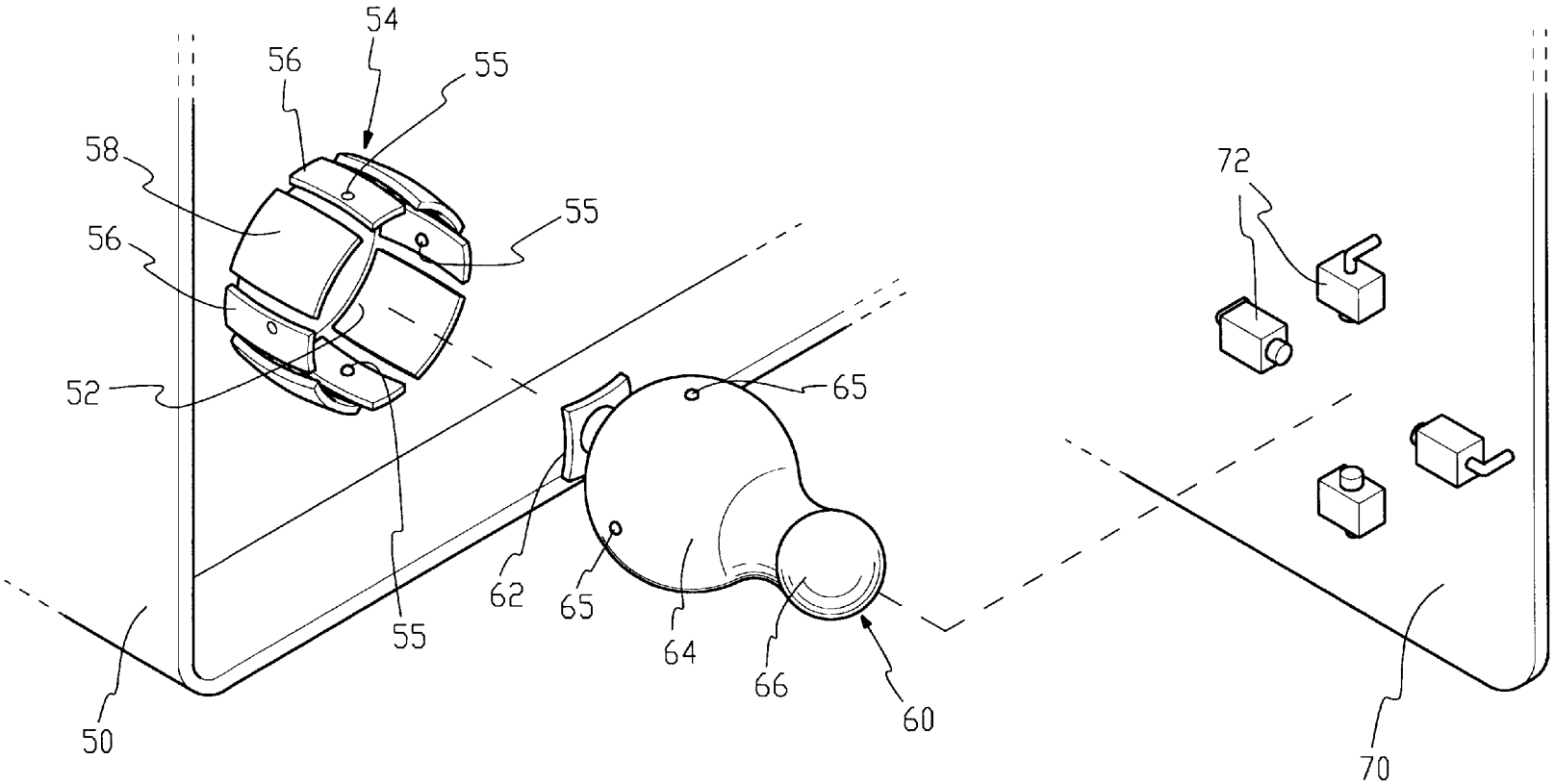
FIG. 3 depicts an exploded perspective view showing a knob assembly for use in electronic appliances in accordance with the present invention.
Figure 4:
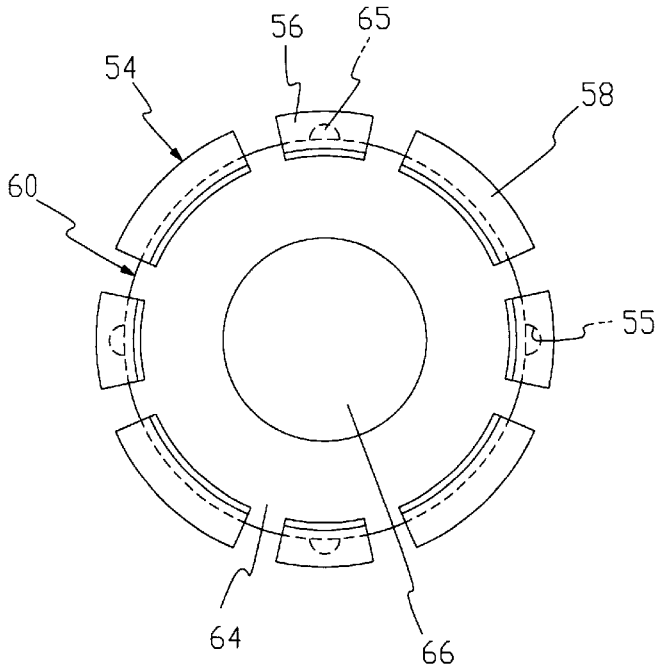
FIG. 4 offers a rear view of the knob assembly as shown in FIG. 3.

Referring now to FIGS. 3 and 4, there are shown a knob assembly in accordance with a preferred embodiment of the present invention. The inventive knob assembly includes a front panel 50 having a circular mounting hole 52 at front thereof, a knob 60 freely moved to a voluntary direction, and a front circuit board 70 having tact switches 72 disposed to pressed by an operation of the knob 60.

Further, the front panel 50 is provided with a tension holder 54 backwardly projected around the mounting hole 52 thereof. The holder 54 consists of a plurality of tension ribs in which a first group of tension ribs 56 are vertically and horizontally located and a second group of tension ribs 58 are located between the first group of tension ribs 56, the first group of tension ribs 56 being provided with a groove 55, respectively. Each inner surface of the tension ribs may be preferred dented.

The knob 60 has a knob handle 62 disclosed from the front panel 50, a rotational sphere 64 inserted into the tension holder 54, and a contacting member 66, the rotational sphere 64 being provided with projections 65 on a periphery surface which are coupled with each groove 55 of the first group of tension ribs 56. It is preferred that the length of the second group of tension ribs 58 may be longer than that of the first group of tension ribs 56 to firmly support the rotational sphere 64.

The front circuit board 70 has four tact switches 72 disposed to be pressed by the contacting member 66 of the knob 60.

The knob 60 is restored by a restoring force of the tension holder 54 to a standard position where allows the projections 65 of the rotational sphere 64 always to be coupled with each groove 55 of the first group of tension ribs 56.

Figure 5:
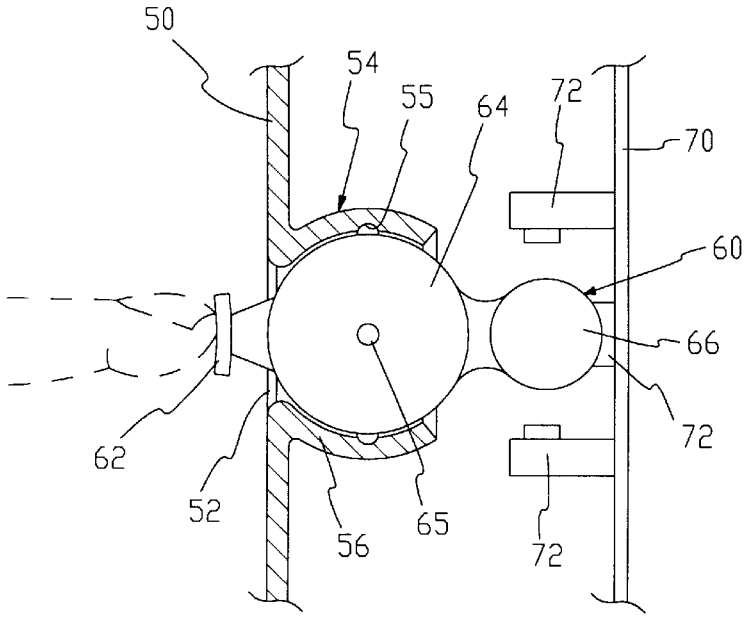
FIG. 5 illustrates a sectional view showing a standard position of the knob assembly in accordance with the present invention.

When the knob handle 62 id shifted toward an upper direction from the standard position as shown in FIG. 5, the projections 65 of the rotational sphere 64 is released from the grooves 55 of the first group of tension ribs 56 so that the first group of tension ribs 56 becomes sightly opened. Further, the lower tact switch 72 of the front circuit board 70 is pressed by the contacting member 66 of the knob 60, thereby selecting a desired function of electronic appliances.

Figure 6:
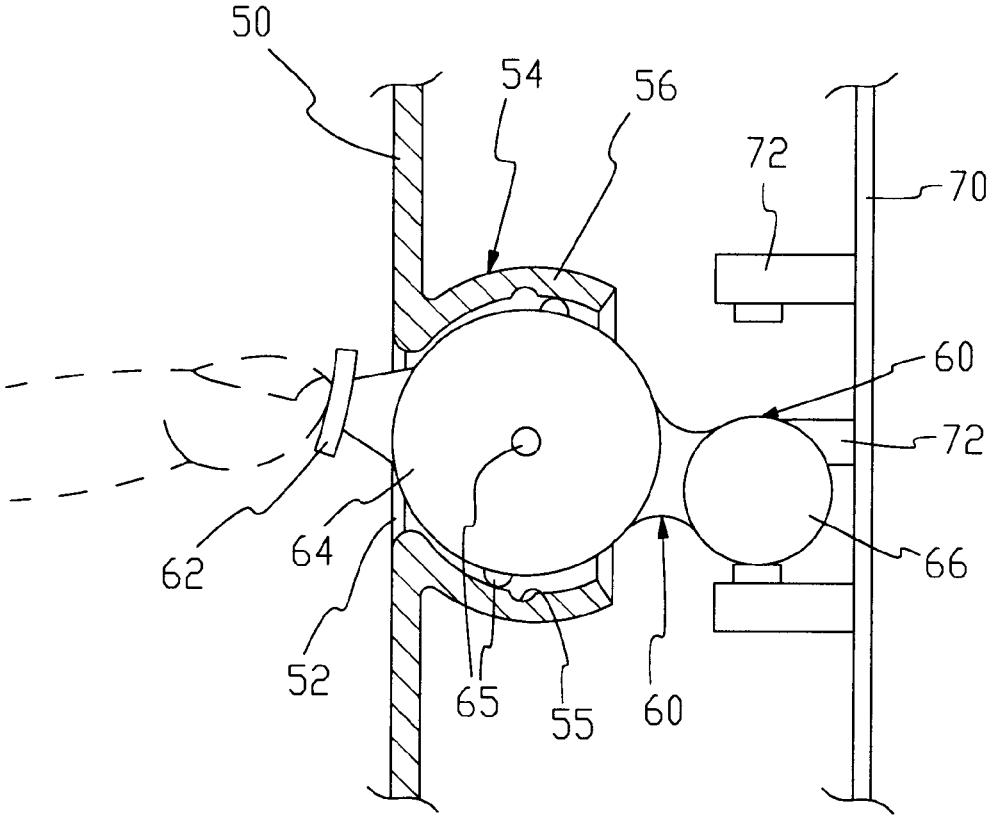
FIG. 6 represents a sectional view showing a contacting position of the knob assembly in accordance with the present invention.

Thereafter, when the force subjected to the knob handle 62 is removed as shown in FIG. 6, the projections 65 of the rotational sphere 64 is slid along the dented inner surface of the tension holder 54 and coupled with the groove 55 of the first group of tension ribs 56 by the restoring force of the tension holder 54.

Although the invention has been shown and described with respect to the preferred embodiments, it will be understood by those skilled in the art that certain changes and modifications may be made without departing from the spirit and scope of the invention as defined in the following claims.

What is claimed is:

1. A knob assembly for use in electronic appliances, said knob assembly comprising:

a front panel having a circular mounting hole at a front thereof and a tension holder backwardly projected around the mounting hole, the holder consisting of a plurality of tension ribs in which a first group of the tension ribs are vertically and horizontally located and a second group of the tension ribs are located between the first group of tension ribs, the first group of tension ribs being provided with a groove, respectively;

a knob freely moved to a voluntary direction and having a knob handle extending from the front panel, a rotational sphere inserted into the tension holder, and a contacting member, the rotational sphere being provided with projections on a periphery surface which are coupled with each of the grooves of the first group of tension ribs; and a front circuit board having tact switches disposed to be pressed by the contacting member of the knob, wherein the knob is restored by a restoring force of the tension holder to a standard position which allows the projections of the rotational sphere always to be coupled with each of the grooves of the first group of tension ribs.

2. The knob assembly of claim 1, wherein the length of the second group of tension ribs is longer than that of the first group of tension ribs to firmly support the rotational sphere.

3. The knob assembly of claim 1, wherein the inner surfaces of the tension ribs are dented to allow the rotatinal sphere to be slid.

* * * * *